United States Patent [19]

Moraw et al.

[11] 4,353,639

[45] Oct. 12, 1982

[54] DEVICE FOR REMOVING DEVELOPER LIQUID FROM A RECORDING MATERIAL

[75] Inventors: Roland Moraw; Günther Schädlich, both of Wiesbaden, Fed. Rep. of Germany

[73] Assignee: Hoechst Aktiengesellschaft, Frankfurt am Main, Fed. Rep. of Germany

[21] Appl. No.: 266,977

[22] Filed: May 26, 1981

[30] Foreign Application Priority Data

Jun. 4, 1980 [DE] Fed. Rep. of Germany ..... 3021050

[51] Int. Cl.[3] ..... G03G 15/10

[52] U.S. Cl. ..... 355/10; 355/14 D

[58] Field of Search ..... 355/10, 14 D, 87, 91, 355/15; 118/661

[56] References Cited

U.S. PATENT DOCUMENTS

| | | | |
|---|---|---|---|
| T967,010 | 2/1978 | Stryjewski | 432/60 |
| 2,913,353 | 11/1959 | Mayer et al. | 118/661 |
| 3,169,887 | 2/1965 | York | 118/661 |
| 3,907,423 | 9/1975 | Hayashi et al. . | |
| 4,017,174 | 4/1977 | Cheeseman | 355/10 |
| 4,032,229 | 6/1977 | Tani et al. | 355/10 X |
| 4,205,622 | 6/1980 | Miyake et al. | 355/10 X |
| 4,278,345 | 7/1981 | Davis et al. | 355/15 |

FOREIGN PATENT DOCUMENTS

| | | |
|---|---|---|
| 0003051 | 7/1979 | European Pat. Off. . |
| 1294199 | 4/1969 | Fed. Rep. of Germany . |
| 2259482 | 6/1973 | Fed. Rep. of Germany . |
| 2438079 | 3/1975 | Fed. Rep. of Germany . |
| 2520456 | 12/1975 | Fed. Rep. of Germany . |

*Primary Examiner*—A. C. Prescott

*Attorney, Agent, or Firm*—Schwartz, Jeffery, Schwaab, Mack, Blumenthal & Koch

[57] ABSTRACT

Disclosed is a device for use in an electrophotographic copying machine to remove developer liquid from a recording material, comprising a rotatable drum carrying on its outside circumferential surface the recording material which is intended to be charged and exposed to an optical image of an original in order to produce a latent charge image thereon; and a roller mounted parallel to the drum for rotation in the direction opposite to the direction of movement of the recording material for applying a developer liquid to the latent charge image on the drum. The roller is arranged to provide a gap between the roller and the recording material, and the roller comprises a surface layer of a material having a smaller coefficient of friction than the recording material and a thickness such that the gap between the roller and the recording material on the drum is less than about 0.05 mm.

14 Claims, 5 Drawing Figures

DEVICE FOR REMOVING DEVELOPER LIQUID FROM A RECORDING MATERIAL

BACKGROUND OF THE INVENTION

The present invention relates to a device for removing developer liquid from a recording material present in an electrophotographic copying machine in which the recording material is charged and exposed to an optical image of an original, and the latent charge image obtained is developed into a visible image by applying developer liquid. For the purpose of applying the developer liquid, a roller rotating in the direction opposite to the direction of movement of the recording material is used, and the roller is arranged in such a way that a gap is produced between the roller and the recording material.

A device of this type is described in U.S. Pat. No. 3,907,423. In this device, a squeezing roller for removing the developer liquid rotates in a collecting vessel and thereby removes developer liquid from the photoconductor layer. The smaller the gap is between the photoconductor layer and the counter-rotating roller, the better is the stripping effect. In this device, the width of the gap is between about 0.05 and 1 mm. The roller is electrically insulated from the copier, and a bias voltage is applied to it. In order to make sure that the gap is always maintained, support rollers are provided at the side of the squeezing roller, which rolls with the aid of said support rollers.

By means of a doctor appliance which is firmly disposed in close proximity to the roller, excess developer liquid is removed and the roller is cleaned. The developer liquid stripped off by the doctor appliance is collected in the collecting vessel.

It is necessary to remove the excess developer liquid in order to ensure that only a developer liquid layer having an exactly defined thickness remains on the surface of the recording material and to facilitate cleaning of the photoconductor layer before a new copying cycle is started. By reducing the thickness of the developer liquid layer present on the photoconductor layer prior to transmitting the developed charge image, the quality of the transmitted charge image is improved, and the copies can be dried more easily.

In the device known from German Offenlegungsschrift No. 19 37 019, a squeezing roller is pressed against the surface of a recording material, whereby excess developer liquid is squeezed off. This process involves the danger, however, of damaging the toner image.

In the device known from U.S. Pat. No. 3,596,635, too, a roller touching the surface of the recording material is provided, by means of which excess developer liquid is removed from the surface of the recording material. A problem arising with all of these known devices is, however, that the pressure between the squeezing roller and the surface of the recording material may vary considerably, since it is very difficult to produce rollers having perfectly even and uniformly curved circumferential surfaces. Photoconductor drums, to the circumferential surfaces of which the recording materials are applied, in general have bulging or barrel-shaped deformations, whereby deviations from an ideal cylindrical surface of up to 0.02 mm may occur, and in rare cases these deviations are even higher. The diameters of squeezing rollers are also subjected to certain manufacturing variations due to the after-treatment of their surfaces, so that, in cases where the squeezing rollers are in direct contact with a photoconductor drum, it must be taken into account that there are differences in pressure between the two rollers, which may lead to an irregular transmission of the toner images from the photoconductor drum to the image-receiving material.

The squeezing rollers conventionally employed in electrophotographic copying machines usually have an aluminum surface which is provided with an anodized coating. It has been shown that, when the squeezing roller has been in use for a longer time, fine grooves form even in the anodized layer due to dust settling on the doctor. These grooves may negatively influence the stripping-off by means of the doctor of the excess developer liquid squeezed off the photoconductor drum.

An effort must therefore be made to maintain as small as possible the gap between the photoconductor drum, or, respectively, the recording material, and the squeezing roller for removing the excess developer liquid. It is not possible, however, to realize this aim of reducing the gap width, and at the same time always and at each point maintain a gap, merely by changing the diameter of the support rollers on which the squeezing roller rolls or by changing the diameter of the squeezing roller. This is because of the abovementioned irregularities in the curvature of the cylindrical surfaces occurring during the manufacturing process.

SUMMARY OF THE INVENTION

It is therefore an object of the present invention to provide an improved device for removing the developer liquid from a recording material present in an electrophotographic copying machine.

It is a further object of the invention to provide such a device wherein the developer liquid transmitted from the recording material to the image-receiving material is reduced to a quantity sufficiently high to make possible a perfect image development.

Another object of the invention resides in the provision of such a device which at the same time reduces the ecological problems caused by hydrocarbon evaporated from the dispersing agent of the developer liquid.

Still another object of the invention is to provide an improved electrophotographic copying machine which embodies the improved developer liquid removal device according to the invention.

In accomplishing the foregoing objects, there has been provided in accordance with the present invention a device for use in an electrophotographic copying machine to remove developer liquid from a recording material, comprising a rotatable drum carrying on its outside circumferential surface the recording material which is intended to be charged and exposed to an optical image of an original in order to produce a latent charge image thereon; and a roller mounted parallel to the drum for rotation in the direction opposite to the direction of movement of the recording material for applying a developer liquid to the latent charge image on the drum, the roller being arranged to provide a gap between the roller and the recording material, and the roller comprising a surface layer of a material having a smaller coefficient of friction than the recording material and a thickness such that the gap between the roller and the recording material on the drum is less than about 0.05 mm, preferably between about 0.025 and 0.030 mm. Preferably, the surface layer of the roller is comprised of a material which is softer than the recording material, e.g., a silicone resin or a polymer, e.g., polyester, polyurethane or polyfluoroethylene.

In another embodiment, the surface layer of the roller is comprised of one or more shrink films of an organic material, such as a heat-shrinkable polyester.

In another embodiment, the surface layer is applied to accommodate any irregularities in the surface of the drum and/or the roller and to produce a uniform width of the gap over the whole length of the roller and of the recording material.

In accordance with another aspect of the present invention, there has been provided an improved electrophotographic copying device comprising a drum for carrying a photoconductive layer; an electric corona discharge device for charging the photoconductive layer; an exposure station for exposing the photoconductive layer to an optical image of an original; and a developing station for developing a latent charge image on the photoconductive layer, wherein the drum and developing station comprise the improved device defined above.

Further objects, features and advantages of the present invention will become apparent to a person skilled in the art from the detailed description of preferred embodiments which follows, when considered together with the attached figures of drawing.

DETAILED DESCRIPTION OF PREFERRED EMBODIMENTS

In accordance with the present invention, the roller is equipped with a surface layer of a material having a smaller coefficient of friction than the recording material and the thickness of this layer is chosen such that the gap between the roller and the recording material is smaller than about 0.05 mm.

The width of the gap between the roller and the recording material preferably varies between about 0.025 and 0.03 mm. The surface layer of the roller is made of a material which is softer than the recording material. Suitable materials for this purpose are silicone resins, polymers, e.g., polyesters, polyurethanes or polyfluoroethylenes, or a shrink film of an organic material. In a further embodiment of this invention, the surface layer of the roller is formed by shrinking on two shrink films. The shrink films preferably employed are polyester shrink tubings which, by the action of hot water or of hot air, shrink onto the roller, whereby their diameter is reduced.

The main advantages which are achieved by means of the present invention are that the surface layer of the squeezing roller can easily be replaced and that the allowable deviations of cylindrical surfaces of the squeezing roller and of the photoconductor drum can be compensated for by adapting the thickness of the surface layer of the squeezing roller to the varying roller diameters.

With reference to the attached drawing figures, several preferred embodiments of the invention are described in more detail below.

Figure 1:
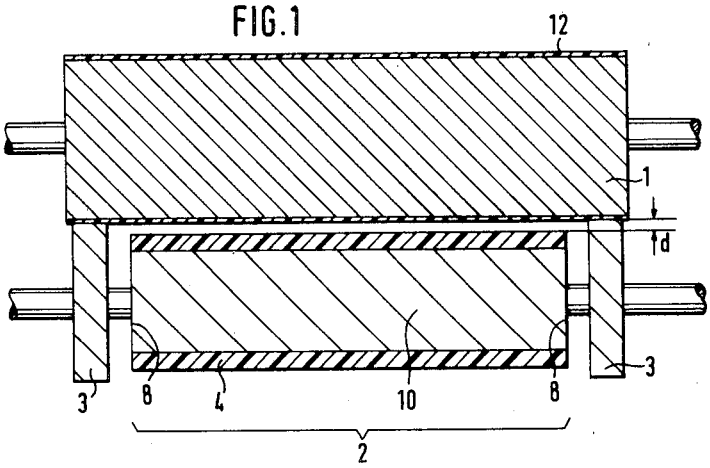
FIG. 1 is a schematic cross-sectional view of an arrangement comprising a photoconductor drum and an exemplary embodiment of the squeezing roller according to the present invention.

The schematic cross-sectional view according to FIG. 1 shows an arrangement comprising a photoconductor drum 1 and a squeezing roller 2 installed at a distance therefrom. It is also possible to use a photoconductor belt wrapped around a roller instead of the photoconductor drum 1 having its circumferential surface covered with the photoconductor 12. In conventional electrophotographic copying machines, the photoconductor layer applied to the photoconductor drum, or, alternatively, the photoconductor belt used as the recording material is charged electrostatically, and the charge image obtained is developed into a pigment image by using a developer liquid of fluid hydrocarbons as the dispersing liquid wherein the dispersed, electrostatically charged pigments are contained. The pigment image thus obtained is then transmitted to an image carrier material which may, e.g., be paper. Before each copying cycle, the photoconductor layer is freed from residual electrostatic charges and pigments.

In order to improve the quality of the pigment image transmitted and to accelerate the drying process of the copies, the thickness of the film of developer liquid present on the photoconductor layer is reduced prior to the transmission to the image carrier material. The electric corona charge device, the exposure station, the developing station, the image transmission station and the cleaning station arranged around the photoconductor drum are conventional in the art and are not shown. These elements are described in more detail, e.g., in U.S. Pat. No. 3,907,423, the disclosure of which is hereby incorporated by reference.

The squeezing roller 2 is composed of a roller core 10 and a surface layer 4. Between the squeezing roller 2 and the photoconductor drum 1, there is a gap having a width d which is less than about 0.05 mm, and preferably is between about 0.025 and 0.03 mm. Supporting rollers 3 are installed on the shaft of the squeezing roller 2, at a small distance from the end surfaces 8. These supporting rollers 3 are adjacent to the photoconductor drum 1 and roll on the latter during the rotary movement of the squeezing roller 2 and the photoconductor drum 1.

The surface layer 4 consists of a material having a smaller coefficient of friction and therefore better sliding properties than the recording material, or, respectively, the photoconductor mounted to the photoconductor drum 1. The width d of the gap depends on the thickness of the surface layer 4. If the width d of the gap is reduced too much, there exists the danger of an undesired contact between the photoconductor layer and the circumferential surface of the squeezing roller 2. Conventional squeezing rollers, which usually are provided with an anodized layer, would then cause irreparable scratches on the photoconductor layer. But as the surface layer 4 is made of a material having a smaller coefficient of friction than the photoconductor layer, the abrasion in case of an unintentional contact between the photoconductor drum 1 and the squeezing roller 2 is negligibly small, and no damage occurs due to the fact that the surface layer 4 is softer than the photoconductor layer. Suitable materials for the surface layer 4 are silicone resins, e.g., silicone rubbers, polymers, e.g., polyesters, polyurethanes or polyfluoroethylenes, or organic films.

The good sliding ability of these materials is of special importance with regard to the actual operating practice of the device, since, in cases where the gap widths amount to less than 0.05 mm, direct copying tests are the only way to find out whether it is possible to further reinforce the surface layer 4, i.e., to continue to reduce the width d of the gap, or whether the photoconductor drum 1 and the surface layer 4 of the squeezing roller 2 already contact each other, which will be the case is blurred areas form on the respective parts of the copies.

Figure 2:
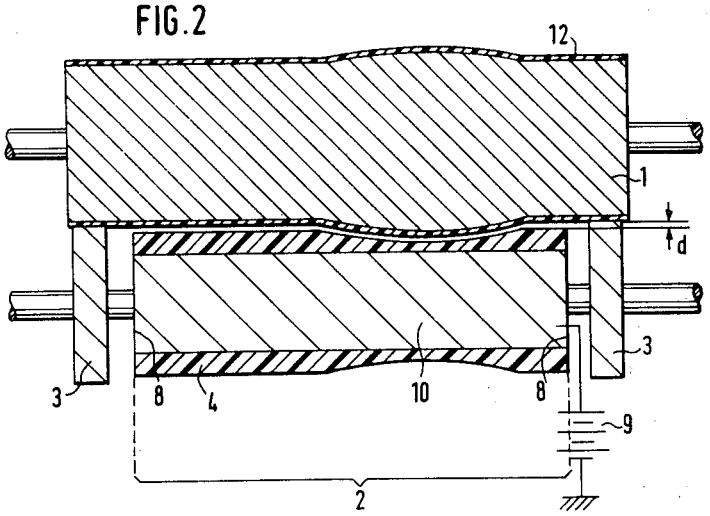
FIG. 2 is a schematic cross-sectional view of an arrangement comprising a photoconductor drum having an irregular diameter over the length of the drum and a squeezing roller having a diameter adapted thereto.

FIG. 2 shows a schematic cross-sectional view of an arrangement wherein the photoconductor drum 1 has an irregular diameter over the length of the drum and wherein the shape of the squeezing roller 2 is adapted to that of the photoconductor drum. Of course, the bulging or barrel-like deformation of the photoconductor drum 1 has been exaggerated in FIG. 2 for the purpose of illustration. The core 10 of the squeezing roller 2 is connected to a power source 9 supplying either a fixed or a variable voltage.

In this arrangement, the surface layer 4 of the squeezing roller 2 has, e.g., been formed by spray-coating it with a solution of poly-N-vinyl carbazole in tetrahydrofurane. The spray application offers the opportunity to build up the surface layer 4 in several steps, whereby after each spraying step the roller is inserted into the copying machine, and test copies are produced to find out whether or not blurred areas form. The polymer indicated above is a material which can also be employed as the photoconductor. In this case, however, no use is made of its photoconductivity. What counts, rather, is the fact that poly-N-vinyl carbazole is insoluble in the dispersing liquid used for the toner pigments. The dispersing liquid is typically an aliphatic hydrocarbon.

It has been shown that, by the spray application of the surface layer 4, the surface of the squeezing roller 2 can be adjusted to the shape of the surface of the photoconductor drum 1 quite easily, since the spraying-on does not necessarily lead to a uniformly increasing thickness of the surface layer 4 over the whole length of the squeezing roller 2. For compensating or balancing the barrel-shaped or convex or concave deformations over the whole length of the photoconductor drum 1, the thickness of the surface layer 4 sprayed on may be increased or decreased opposite those areas where the photoconductor drum 1 shows deformations, so that the gap has a uniform width d over the whole length of the squeezing roller 2 and the photoconductor drum 1.

Figure 3:
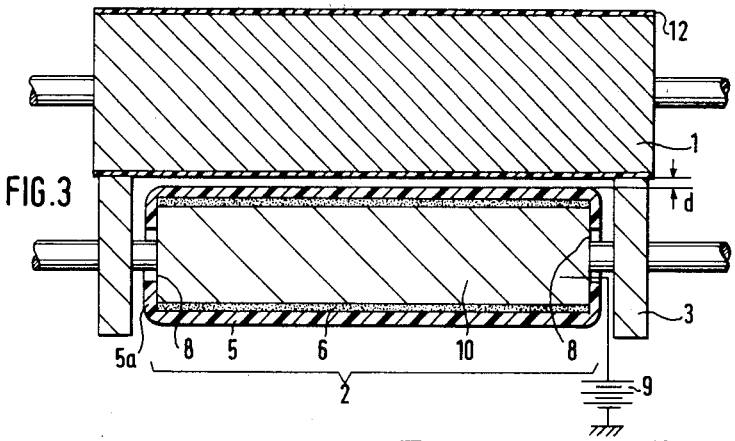
FIG. 3 is a schematic cross-sectional view of an arrangement comprising a photoconductor drum and another embodiment of the squeezing roller.

Surface layers of materials in the form of organic films, such as, e.g., shrink films or shrink tubings, have proved especially suitable for obtaining a service life of the surface layer 4 of some ten thousand copies. FIG. 3 shows a squeezing roller 2 onto which a shrink film 5 of an organic material has been applied. This film preferably is a polyester shrink tubing which is shrunk onto the squeezing roller 2 by the action of hot air or of hot water having a temperature of more than 100° C. Such a polyester shrink tubing may, e.g., have a diameter 32 mm and then be shrunk onto a squeezing roller 2 having a diameter of 28 mm. In order to avoid the formation of creases in the shrink tubing during use, a heat seal layer 6 having a thickness of between about 5 and 10 μm is applied either to the inner side of the shrink film or to the circumferential outer surface of the roller core 10 of the squeezing roller 2, prior to shrinking on the film. The heat seal layer 6 may be composed of a conventional thermoplastic adhesive which is not at all or to only a very limited degree soluble in the dispersing liquid of the developer liquid. Suitable thermoplastic adhesives are, e.g., made of polystyrene or of wax-resin blends and have softening temperatures of 80° C. and higher.

Prior to shrinking on, the end surfaces 8 of the squeezing roller 2 are laterally overlapped by end pieces 5*a* of the shrink film 5. During the shrinking-on process, these end pieces 5*a* undergo a stronger contraction than those parts of the shrink film 5 shrinking directly onto the roller core 10, and therefore closely join to the end surfaces 8. Thus it is avoided that the shrink film 5 tears or that some of the dispersing liquid penetrates between the shrink film 5 and the surface of the roller core 10 of the squeezing roller 2.

The roller core 10 of the squeezing roller 2 is connected to a power source, and a voltage of, e.g., +500 V, is applied to the squeezing roller.

Using a squeezing roller 2 which had been covered with a film tubing 5 of a thickness of 0.02 mm, tests to determine the discharge quantity of dispersing liquid were made in a conventional copying machine. The heating device for drying the copies had been switched off for this purpose. The weight of the copies was determined before and after copying. A dispersion liquid discharge of 0.069 g/DIN A4 copy was calculated from the weight difference measured. When a squeezing roller 2 without a shrink film coating was used, the discharge quantity of dispersing liquid amounted to 0.108 g/DIN A4 copy, the nominal gap width d between the squeezing roller 2 and the photoconductor drum 1 was 0.05 mm. Similar results were obtained with different dispersing liquids, such as, e.g., Isopar G, Isopar H, Isopar L and Isopar M, which all are aliphatic hydrocarbons. When a squeezing roller with a shrunk-on film was used for performing the tests, the gap width d between the squeezing roller 2 (coated with a film tubing 5 having a thickness of 0.02 mm) and the photoconductor drum 1 consequently was 0.03 mm.

When two films were shrunk onto the squeezing roller 2 (i.e., the actual thickness of the film tubing was 0.04 mm), the quantity of dispersing liquid discharged amounted to only 0.02 g/DIN A4 copy, but blurred areas formed on the copies, so that a gap width d of only 0.01 mm between the squeezing roller 2 and the photoconductor drum 1 is not practicable. By means of practical tests it has been found that the lower limit of the gap width is about 0.025 mm.

It is obvious that, by means of shrink films having graded thicknesses of, e.g., 0.020 mm, 0.025 mm, 0.030 mm and 0.035 mm, a rapid and individual adjustment of the gap width d between the squeezing roller 2 and the photoconductor drum 1 can be carried out in a device for removing excess developer liquid which is installed in a copying machine.

Figure 4:
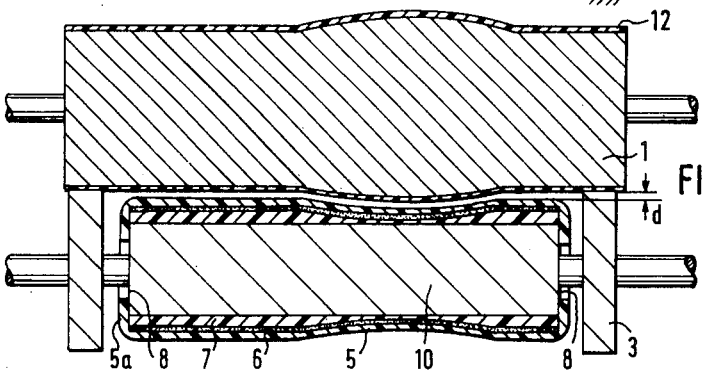
FIG. 4 is a schematic cross-sectional view of an arrangement comprising a photoconductor drum having an irregular diameter and a squeezing roller adapted thereto, in an embodiment according to FIG. 3.

FIG. 4 shows an arrangement comprising a photoconductor drum 1 having an irregular diameter over the length of the photoconductor and a further embodiment of the squeezing roller 2 which is shaped in accordance with the photoconductor drum 1. In this embodiment, the circumferential surface of the roller core 10 of the squeezing roller 2 is coated, by spray application, with a shapeable layer 7 which may, e.g., be a polymer. In FIG. 4, too, the barrel-shaped deformation of the photoconductor drum 1 is rather exaggerated. The shapeable layer 7 is adapted to the surface shape of the photoconductor drum 1 in such a way that the gap has a uniform width d over the whole length of the photoconductor drum. As soon as the shapeable layer 7 has hardened, a shrink tubing 5, the inside surface of which is provided with a heat seal layer 6, is shrunk onto the squeezing roller 2, by means of the process described above.

Figure 5:
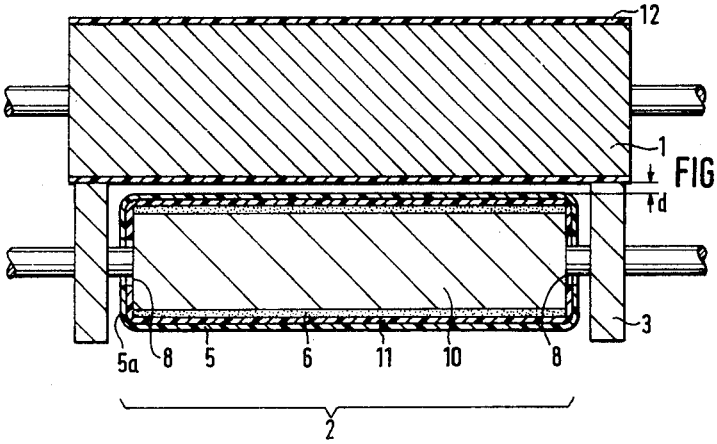
FIG. 5 is a schematic cross-sectional view, similar to the embodiment of FIG. 3, but wherein two shrink films are present on the squeezing roller.

FIG. 5 shows an arrangement comprising a squeezing roller 2 and a photoconductor drum 1, which is built up similar to the arrangement shown in FIG. 3, except for the fact that, instead of one single film tubing 5, two film tubings 5 and 11 are shrunk onto the core 10 of the squeezing roller 2.

The film tubings, or respectively the polyester shrink tubings, are very stable; for example, they do not show any signs of wear even after running 15,000 copies. The advantages which are achieved by using squeezing rollers of the type described above, and in particular squeezing rollers coated with shrunk-on tubings, are that (1) compared with conventional devices for removing excess developer liquid, the discharge quantity of dispersing liquid is considerably reduced and that (2) the surface layer of the squeezing roller can be replaced without much expenditure of labor. For applying a new surface layer, it is, e.g., simply necessary to cut open one side of the film tubing and to tear the film off the squeezing roller which is additionally freed from residual thermoplastic adhesive by means of a solvent. Then a new film tubing is shrunk onto the squeezing roller.

Surface layers which have been formed by spray application of a polymer can also be replaced quite easily and simply. These sprayed-on layers are washed off with a suitable solvent, then the new layers can be sprayed on.

What is claimed is:

1. A device for use in an electrophotographic copying machine to remove developer liquid from a recording material, comprising:

a rotatable drum carrying on its outside circumferential surface the recording material which is intended to be charged and exposed to an optical image of an original in order to produce a latent charge image thereon; and a roller mounted parallel to said drum for rotation in the direction opposite to the direction of movement of the recording material for applying a developer liquid to the latent charge image on said drum, said roller being arranged to provide a gap between the roller and the recording material, and said roller comprising a surface layer of a material having a smaller coefficient of friction than the recording material and a thickness such that the gap between said roller and said recording material on said drum is less than about 0.05 mm.

2. A device as claimed in claim 1, wherein the width of said gap between said roller and the recording material is in a range of from about 0.025 mm to 0.030 mm.

3. A device as claimed in claim 1, wherein the surface layer of said roller is comprised of a material which is softer than the recording material.

4. A device as claimed in claim 3, wherein the surface layer of said roller is comprised of a silicone resin or a polymer.

5. A device as claimed in claim 3, wherein the surface layer of said roller is comprised of a shrink film of an organic material.

6. A device as claimed in claim 5, wherein the surface layer of said roller is formed by shrinking on two shrink films.

7. A device as claimed in claim 5, wherein the shrink films comprise heat-shrinkable polyester shrink films.

8. A device as claimed in claim 5, further comprising a heat sealing layer on the inside of the shrink films, said heat sealing layer having a thickness of from about 5–10 μm.

9. A device as claimed in claim 8, wherein said heat sealing layer is insoluble in the dispersing liquid of the developer liquid.

10. A device as claimed in claim 4, wherein the surface layer of said roller is formed by spraying on a solution of poly-N-vinyl carbazole in tetrahydrofurane.

11. A device as claimed in claim 10, wherein the spray application of the surface layer is carried out to accommodate any irregularities in the surface of said drum and/or said roller and to produce a uniform width of said gap over the whole length of said roller and of the recording material.

12. A device as claimed in claim 1, wherein each surface of said roller is overlapped by an end piece of each shrink film and wherein the two end pieces are shrunk to such a degree that they are adjacent to the end surfaces of said roller and seal the latter so that no developer liquid can penetrate under the shrink films.

13. A device as claimed in claim 8, wherein a shapeable layer is applied onto said roller and said shapeable layer is adjusted to the circumferential surface of said drum.

14. In an electrophotographic copying machine including a drum for carrying a photoconductive layer; and a developing station for developing a latent charge image on the photoconductive layer, the improvement comprising said drum and said developing station comprising a device as defined by claim 1.

* * * * *